US007867966B2

(12) United States Patent
Seebeck et al.

(10) Patent No.: US 7,867,966 B2
(45) Date of Patent: Jan. 11, 2011

(54) MIXED POWDER OR MIXED GRANULE BASED ON GLUTAMIC ACID-N, N-DIACETIC ACID AND SALTS THEREOF

(75) Inventors: Tanja Seebeck, Bensheim (DE); Lars Kissau, Wachenheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 210 days.

(21) Appl. No.: 12/159,095

(22) PCT Filed: Dec. 21, 2006

(86) PCT No.: PCT/EP2006/070063

§ 371 (c)(1),
(2), (4) Date: Jun. 25, 2008

(87) PCT Pub. No.: WO2007/077143

PCT Pub. Date: Jul. 12, 2007

(65) Prior Publication Data

US 2008/0300159 A1 Dec. 4, 2008

(30) Foreign Application Priority Data

Jan. 3, 2006 (EP) ..... 06100033

(51) Int. Cl.

| | |
|---|---|
| ***C11D 3/33*** | (2006.01) |
| ***C11D 3/37*** | (2006.01) |
| ***C11D 10/02*** | (2006.01) |
| ***D06L 1/00*** | (2006.01) |
| ***B08B 9/20*** | (2006.01) |

(52) U.S. Cl. ..... 510/218; 510/220; 510/356; 510/360; 510/443; 510/444; 510/445; 510/452; 510/475; 510/480; 8/137; 134/25.2

(58) Field of Classification Search ..... 510/218, 510/220, 356, 360, 443, 444, 445, 452, 475, 510/480; 8/137; 134/25.2
See application file for complete search history.

(56) References Cited

U.S. PATENT DOCUMENTS

| | | | | |
|---|---|---|---|---|
| 4,349,447 | A * | 9/1982 | Noguchi et al. | 510/355 |
| 5,929,006 | A * | 7/1999 | Saito et al. | 510/185 |

FOREIGN PATENT DOCUMENTS

| | | | |
|---|---|---|---|
| EP | 0618289 | | 10/1994 |
| EP | 0 783 034 | | 7/1997 |
| EP | 0 864 638 | | 9/1998 |
| EP | 0 884 381 | | 12/1998 |
| EP | 0 885 953 | | 12/1998 |
| EP | 0913461 | A1 * | 5/1999 |
| EP | 1 067 172 | | 1/2001 |
| EP | 1580302 | A1 * | 9/2005 |
| JP | 10046187 | | 2/1998 |
| JP | 11050094 | A * | 2/1999 |
| JP | 11323393 | A * | 11/1999 |
| JP | 02000198720 | A * | 7/2000 |
| WO | 95 29216 | | 11/1995 |
| WO | 98 50510 | | 11/1998 |

* cited by examiner

*Primary Examiner*—Lorna M Douyon
(74) *Attorney, Agent, or Firm*—Oblon, Spivak, McClelland, Maier & Neustadt, L.L.P.

(57) ABSTRACT

A mixed powder or mixed granule comprising at least 80% by weight of a mixture of (a) from 5 to 95% by weight of at least one glutamic acid-N,N-diacetic acid derivative of the general formula (I)

$$MOOC—(CH_2)_2C(COOM)-N(CH_2COOM)_2 \quad (I)$$

where
M is hydrogen, ammonium, alkali metal, (b) from 5 to 95% by weight of at least one polyethylene glycol or of at least one nonionic surfactant or of a mixture thereof or of a polymer selected from the group consisting of polyvinyl alcohols, polyvinylpyrrolidones (PVP), polyalkylene glycols and derivatives thereof, processes for producing these mixed powders or mixed granules, the use of these mixed powders or mixed granules, and a solid laundry detergent and a solid dishwasher detergent comprising the inventive mixed powder or mixed granule are described.

19 Claims, No Drawings

MIXED POWDER OR MIXED GRANULE BASED ON GLUTAMIC ACID-N, N-DIACETIC ACID AND SALTS THEREOF

The invention relates to a mixed powder or mixed granule based on glutamic acid-N,N-diacetic acid or salts thereof.

To produce detergents, especially laundry detergents, or cleaning compositions, especially dishwasher detergents, solid or liquid formulations may be selected. Solid formulations may be present, for example, in powder or in granule form. The production of individual pulverulent or granular detergent constituents or constituent mixtures may be difficult or impossible depending on the type of the constituents. The powders or granules must not cake together in the course of production, in the course of mixing and in the course of storage of the compositions, and must not impair the scattering or free-flowing capability of the powder or granule.

The use of chelating agents in laundry detergents in solid form is known. WO 95/29216 relates to detergent powder compositions which comprise a metal ion-chelate complex and an anionic functional polymer. The detergent powder comprises a complex of a chelating agent and a metal ion, selected from magnesium, calcium, strontium, zinc and aluminum, and a polymer which in particular has carboxyl groups. The powder is produced by spray-drying. The chelating agents may be selected from a multitude of compounds, but glutamic acid-N,N-diacetic acid and salts thereof are not mentioned. Among the usable polymers, polycarboxylates are listed which comprise water-soluble salts of homo- and copolymers of aliphatic carboxylic acids.

EP-A-0 618 289 also relates to highly active granular detergent compositions which comprise chelates and polymers. The composition has an anionic surfactant, a chelating agent and a polymer or copolymer. The chelating agents may in turn be selected from a multitude of compounds. However, glutamic acid-N—N-diacetic acid and salts thereof are not listed. Among the polymers, polycarboxylates in particular, such as polyacrylates, are listed.

It is an object of the present invention to provide mixed powders or mixed granules comprising glutamic acid-N,N-diacetic acid or salts thereof for use in solid laundry detergents and cleaning compositions. In particular, the pouring and free-flowing capability of the powders or granules should be retained.

According to the invention, the object is achieved by a mixed powder or mixed granule comprising at least 80% by weight of a mixture of (a) from 5 to 95% by weight of glutamic acid-N,N-diacetic acid and/or one or more salts thereof of the general formula (I)

$$\text{MOOC—(CH}_2)_2\text{—C(COOM)-N(CH}_2\text{COOM)}_2 \quad \text{(I)}$$

where

M is H, $NH_4$, alkali metal, (b) from 5 to 95% by weight of at least one polyethylene glycol or of at least one nonionic surfactant or of a mixture thereof or of a polymer selected from the group consisting of polyvinyl alcohols, polyvinylpyrrolidones (PVP), polyalkylene glycols and derivatives thereof.

The remaining proportion may be accounted for by further assistants, such as customary laundry detergent additives or fillers. The mixture preferably consists substantially, more preferably only, of the components (a) and (b).

In one embodiment, the mixture comprises, as component (b), from 5 to 95% by weight of at least one polyethylene glycol or of at least one nonionic surfactant or of a mixture thereof.

It has been found in accordance with the invention that a combination of alkali metal salts of glutamic acid-N,N-diacetic acid with at least one polyethylene glycol or at least one nonionic surfactant or a mixture thereof or a polymer selected from the group consisting of polyvinyl alcohols, polyvinylpyrrolidones (PVP), polyalkylene glycols and derivatives thereof leads to powders or granules which have a low hygroscopicity and good storage performance, and can therefore be used advantageously in solid laundry detergents and cleaning compositions. The compositions are very storage-stable and still pourable and free-flowing even after long periods.

Suitable glutamic acid-N,N-diacetic acid and salts thereof are accordingly compounds of the general formula (I)

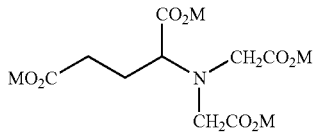

(I)

in which

M is hydrogen, ammonium or alkali metal.

In the compounds of the general formula (I), M is hydrogen (H), ammonium ($NH_4$) or an alkali metal (e.g. Li, Na, K), preferably sodium or potassium, more preferably sodium.

The component (b) used is at least one polyethylene glycol or at least one nonionic surfactant or a mixture thereof, or a polymer selected from the group consisting of polyvinyl alcohols, polyvinylpyrrolidones (PVP), polyalkylene glycols and derivatives thereof.

The component (b) used is preferably a polyethylene glycol, more preferably having an average molecular weight (weight-average molecular weight) of from 500 to 30 000 g/mol.

In a preferred embodiment, the polyethylene glycol used as component (b) has OH end groups and/or $C_{1-6}$-alkyl end groups. The component (b) used in the inventive mixture is more preferably a polyethylene glycol which has OH and/or methyl end groups.

The polyethylene glycol used in the inventive mixture preferably has a molecular weight (weight-average molecular weight) of from 1000 to 5000 g/mol, most preferably from 1200 to 2000 g/mol.

Suitable compounds which can be used as component (b) are nonionic surfactants. These are preferably selected from the group consisting of alkoxylated primary alcohols, alkoxylated fatty alcohols, alkylglycosides, alkoxylated fatty acid alkyl esters, amine oxides and polyhydroxy fatty acid amides.

The nonionic surfactants used are preferably alkoxylated, advantageously ethoxylated, in particular primary alcohols having preferably from 8 to 18 carbon atoms and on average from 1 to 12 mol of ethylene oxide (EO) per mole of alcohol, in which the alcohol radical may be linear or preferably 2-methyl-branched, or may comprise a mixture of linear and branched radicals, as are typically present in oxo alcohol radicals. However, especially preferred alcohol ethoxylates have linear radicals of alcohols of native origin having from 12 to 18 carbon atoms, for example of coconut, palm, tallow fat or oleyl alcohol, and on average from 2 to 8 EO per mole of alcohol. The preferred ethoxylated alcohols include, for example, $C_{12-14}$-alcohols having 3 EO, 4 EO or 7 EO, $C_{9-11}$-alcohols having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3

EO and $C_{12-18}$-alcohol having 7 EO. The degrees of ethoxylation specified are statistical average values which may be an integer or a fraction for a specific product. Preferred alcohol ethoxylates have a narrowed homolog distribution (narrow range ethoxylates, NRE).

In addition to these nonionic surfactants, it is also possible to use fatty alcohols having more than 12 EO. Examples thereof are tallow fat alcohols having 14 EO, 25 EO, 30 EO or 40 EO. It is also possible in accordance with the invention to use nonionic surfactants which comprise EO and PO groups together in the molecule. In this context, block copolymers having EO-PO block units or PO-EO block units may be used, but also EO-PO-EO copolymers or PO-EO-PO copolymers. It will be appreciated that it is also possible to use nonionic surfactants having mixed alkoxylation, in which EO and PO units are not distributed in blocks but rather randomly. Such products are obtainable by simultaneous action of ethylene oxide and propylene oxide on fatty alcohols.

In addition, further nonionic surfactants which may be used are also alkyl glycosides of the general formula RO(G) in which R is a primary straight-chain or methyl-branched, in particular 2-methyl-branched, aliphatic radical having from 8 to 22, preferably from 12 to 18, carbon atoms and G is the symbol which represents a glycose unit having 5 or 6 carbon atoms, preferably glucose. The degree of oligomerization x, which specifies the distribution of monoglycosides and oligoglycosides, is any number between 1 and 10; x is preferably from 1.2 to 1.4.

A further class of nonionic surfactants used with preference, which are used either as the sole nonionic surfactant or in combination with other nonionic surfactants, is that of alkoxylated, preferably ethoxylated or ethoxylated and propoxylated, fatty acid alkyl esters, preferably having from 1 to 4 carbon atoms in the alkyl chain, in particular fatty acid methyl esters.

Nonionic surfactants of the amine oxide type, for example N-tallow alkyl-N,N-dihydroxyethylamine oxide, and of the fatty acid alkanolamide type may also be suitable. The amount of these nonionic surfactants is preferably not more than that of the ethoxylated fatty alcohols, in particular not more than half thereof.

Further nonionic surfactants are polyhydroxy fatty acid amides of the formula (II)

(II)

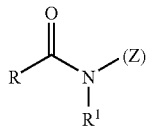

in which RC═O is an aliphatic acyl radical having from 6 to 22 carbon atoms, $R^1$ is hydrogen, an alkyl or hydroxyalkyl radical having from 1 to 4 carbon atoms and (Z) is a linear or branched polyhydroxyalkyl radical having from 3 to 10 carbon atoms and from 3 to 10 hydroxyl groups. The polyhydroxy fatty acid amides are known substances which can typically be obtained by reductively aminating a reducing sugar with ammonia, an alkylamine or an alkanolamine, and subsequently acylating with a fatty acid, a fatty acid alkyl ester or a fatty acid chloride.

The group of polyhydroxy fatty acid amides also includes compounds of the formula (III)

(III)

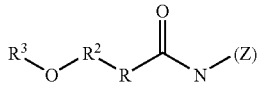

in which R is a linear or branched alkyl or alkenyl radical having from 7 to 12 carbon atoms, $R^2$ is a linear, branched or cyclic alkyl radical or an aryl radical having from 2 to 8 carbon atoms and $R^3$ is H, a linear, branched or cyclic alkyl radical or an aryl radical or an oxyalkyl radical having from 1 to 8 carbon atoms, preference being given to $C_{1-4}$-alkyl or phenyl radicals, and (Z) is a linear polyhydroxyalkyl radical whose alkyl chain is substituted by at least two hydroxyl groups, or alkoxylated, preferably ethoxylated or propoxylated, derivatives of this radical. (Z) is preferably obtained by reductive amination of a sugar, for example glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

Preference is given to using low-foaming nonionic surfactants which have a melting point above room temperature. Accordingly, preferred mixtures comprise nonionic surfactant(s) with a melting point above 20° C., preferably above 25° C., more preferably from 25 to 100° C. and especially preferably from 30 to 50° C.

Suitable nonionic surfactants which have melting and softening points within the temperature range specified are, for example, relatively low-foaming nonionic surfactants which may be solid or highly viscous at room temperature. When nonionic surfactants which have a high viscosity at room temperature are used, they preferably have a viscosity above 20 Pas, preferably above 35 Pas and in particular above 40 Pas. Nonionic surfactants which have a waxlike consistency at room temperature are also preferred.

Nonionic surfactants which are solid at room temperature and are to be used with preference stem from the groups of alkoxylated nonionic surfactants, in particular the ethoxylated primary alcohols and mixtures of these surfactants with structurally complex surfactants, such as polyoxypropylene/polyoxyethylene/polyoxypropylene (PO/EO/PO) surfactants. Such (PO/EO/PO) nonionic surfactants are additionally notable for good foam control.

In a preferred embodiment of the present invention, the nonionic surfactant with a melting point above room temperature is an ethoxylated nonionic surfactant which has resulted from the reaction of a monohydroxyalkanol or alkylphenol having from 6 to 20 carbon atoms with preferably at least 12 mol, more preferably at least 15 mol, in particular at least 20 mol, of ethylene oxide per mole of alcohol or alkylphenol.

A nonionic surfactant which is solid at room temperature and is to be used with particular preference is obtained from a straight-chain fatty alcohol having from 16 to 20 carbon atoms ($C_{16-20}$-alcohol), preferably a $C_{18}$-alcohol, and at least 12 mol, preferably at least 15 mol and in particular at least 20 mol, of ethylene oxide per mole of alcohol. Of these, the "narrow range ethoxylates" (see above) are particularly preferred.

Accordingly, particularly preferred inventive mixtures comprise ethoxylated nonionic surfactant(s) which has/have been obtained from $C_{6-20}$-monohydroxyalkanols or $C_{6-20}$-alkylphenois or $C_{16-20}$-fatty alcohols and more than 12 mol, preferably more than 15 mol and in particular more than 20 mol, of ethylene oxide per mole of alcohol.

The nonionic surfactant preferably additionally has propylene oxide units in the molecule. Preferably, such PO units make up up to 25% by weight, more preferably up to 20% by weight and in particular up to 15% by weight, of the total molar mass of the nonionic surfactant. Particularly preferred nonionic surfactants are ethoxylated monohydroxyalkanols or alkylphenols which additionally have polyoxyethylene-polyoxy-propylene block copolymer units. The alcohol or alkylphenol moiety of such nonionic surfactant molecules preferably makes up more than 30% by weight, more preferably more than 50% by weight and in particular more than 70% by weight, of the total molar mass of such nonionic surfactants. Preferred rinse aids comprise ethoxylated and propoxylated nonionic surfactants in which the propylene oxide units in the molecule make up up to 25% by weight, preferably up to 20% by weight and in particular up to 15% by weight, of the total molar mass of the nonionic surfactant.

Further nonionic surfactants which have melting points above room temperature and are to be used with particular preference comprise from 40 to 70% of a polyoxypropylene/polyoxyethylene/polyoxypropylene block polymer blend which 75% by weight of an inverse block copolymer of polyoxyethylene and polyoxypropylene having 17 mol of ethylene oxide and 44 mol of propylene oxide, and 25% by weight of a block copolymer of polyoxyethylene and polyoxypropylene initiated with trimethylolpropane and comprising 24 mol of ethylene oxide and 99 mol of propylene oxide per mole of trimethylolpropane.

The inventive mixture comprises, as a further preferred nonionic surfactant, a compound of the formula (IV)

$$R^4O[CH_2CH(CH_3)O]_x[CH_2CH_2O]_yCH_2CH(OH)R^5 \quad \text{(IV)}$$

in which $R^4$ is a linear or branched aliphatic hydrocarbon radical having from 4 to 18 carbon atoms or mixtures thereof, $R^5$ is a linear or branched hydrocarbon radical having from 2 to 26 carbon atoms or mixtures thereof, and x is from 0.5 to 1.5, and y is at least 15.

Further nonionic surfactants which can be used with preference are the end group-capped poly(oxyalkylated) nonionic surfactants of the formula (V)

$$R^6O[CH_2CH(R^8)O]_z[CH_2]_kCH(OH)[CH_2]_jOR^7 \quad \text{(V)}$$

in which $R^6$ and $R^7$ are linear or branched, saturated or unsaturated, aliphatic or aromatic hydrocarbon radicals having from 1 to 30 carbon atoms, $R^8$ is hydrogen or a methyl, ethyl, n-propyl, isopropyl, n-butyl, 2-butyl or 2-methyl-2-butyl radical, z is from 1 to 30, k and j are from 1 to 12, preferably from 1 to 5. When z is $\geqq 2$, each $R^8$ in formula (V) may be different. $R^6$ and $R^7$ are preferably linear or branched, saturated or unsaturated, aliphatic or aromatic hydrocarbon radicals having from 6 to 22 carbon atoms, particular preference being given to radicals having from 8 to 18 carbon atoms. For the $R^8$ radical, particular preference is given to hydrogen, methyl or ethyl. Particularly preferred values for z are in the range from 1 to 20, in particular from 6 to 15.

As described above, each $R^8$ in formula (V) may be different if z is $\geqq 2$. This allows the alkylene oxide unit in the square brackets to be varied. When z is, for example, 3, the $R^8$ radical may be selected so as to form ethylene oxide ($R^8$=H) or propylene oxide ($R^8$=$CH_3$) units which can be joined together in any sequence, for example (EO)(PO)(EO), (EO)(EO)(PO), (EO)(EO)(EO), (PO)(EO)(PO), (PO)(PO)(EO) and (PO)(PO)(PO). The value 3 for z has been selected here by way of example and it is entirely possible for it to be larger, the scope of variation increasing with increasing z values and embracing, for example, a large number of EO groups combined with a small number of PO groups, or vice versa.

Especially preferred end group-capped poly(oxyalkylated) alcohols of the formula (V) have values of k=1 and j=1, so that the formula (V) is simplified to formula (VI):

$$R^6O[CH_2CH(R^8)]_zCH_2CH(OH)CH_2OR^7 \quad \text{(VI).}$$

In formula (VI), $R^6$, $R^7$ and $R^8$ are each as defined in formula (V) and z is from 1 to 30, preferably from 1 to 20 and in particular from 6 to 18. Particular preference is given to surfactants in which the $R^6$ and $R^7$ radicals each have from 9 to 14 carbon atoms, $R^8$ is hydrogen and z assumes values of from 6 to 15.

If the latter statements are summarized, preference is given to inventive mixtures which comprise, as nonionic surfactants, end group-capped poly(oxyalkylated) compounds of the formula (V) in which $R^6$ and $R^7$ are linear or branched, saturated or unsaturated, aliphatic hydrocarbon radicals having from 1 to 30 carbon atoms, $R^8$ is hydrogen or a methyl, ethyl, n-propyl, isopropyl, n-butyl, 2-butyl or 2-methyl-2-butyl radical, z is from 1 to 30, k and j are from 1 to 12, preferably from 1 to 5, particular preference being given to surfactants of the formula (VI) in which z is from 1 to 30, preferably from 1 to 20 and in particular from 6 to 18.

Very particular preference is given to nonionic surfactants being present in the inventive mixture as component (b) which are obtainable under the trade name Pluronic® from BASF AG.

The proportion of component (a) is from 5 to 95% by weight, preferably from 40 to 60% by weight. An example of a proportion of component (a) is 50% by weight. Correspondingly, component (b) is present in an amount of from 5 to 95% by weight, preferably from 40 to 60% by weight. An example is an amount of 50% by weight.

The inventive mixed powders or mixed granules may be produced by mixing the two components as a powder and subsequently heating the mixture, especially to a temperature above the melting or softening point of component (b). This melts component (b) which mixes intimately with component (a). In the subsequent cooling and shaping process, the powder properties such as particle size and bulk density are adjusted.

The present invention also relates to a process for producing the inventive mixed powders or mixed granules by mixing components (a) and (b) as a powder, heating the mixture and adjusting the powder properties in the subsequent cooling and shaping process.

It is also possible to granulate component (a) with the already molten component (b) and subsequently to cool it.

In the event of suitable (a)/(b) mixture ratios, it is also possible to stir component (a) into the melt of component (b). The subsequent solidification and shaping is effected in accordance with the known processes of melt processing, for example by prilling or on cooling belts with, if required, subsequent steps for adjusting the powder properties, such as grinding and sieving.

The inventive mixed powders or mixed granules may also be produced by dissolving components (a) and (b) in a solvent and spray-drying the resulting mixture, which may be followed by a granulation step. In this process, components (a) and (b) may be dissolved separately, in which case the solutions are subsequently mixed, or a powder mixture of the components may be dissolved in water. Useful solvents are all of those which can dissolve components (a) and (b); preference is given to using, for example, alcohols and/or water, particular preference to using water.

The present invention thus also relates to a process for producing the inventive mixed powders or mixed granules by dissolving components (a) and (b) in a solvent and spray-drying the resulting mixture, which may be followed by a granulation step and/or a melt granulation step (see above).

The present invention also relates to the use of the inventive mixed powders or mixed granules for producing solid laundry detergents and cleaning compositions, for the laundering of textiles or for the cleaning of tableware and kitchenware. As mixed powders or mixed granules, both components develop an action in laundry detergents and cleaning compositions, for example as dishwasher compositions for machine dishwashers.

The mixed powders or mixed granules may be incorporated into pulverulent laundry detergents and cleaning compositions, without these forming lumps or caking.

The invention also relates to a solid cleaning composition comprising a mixed powder or mixed granule as described above and, if appropriate, at least one further surfactant. Suitable cleaning compositions are known and are described, for example, in WO 95/29216 and EP-A-0 618 289.

The invention further relates to a solid dishwasher detergent which comprises a mixed powder or mixed granule as described above and additionally, if appropriate, at least one (further) surfactant. The compositions are preferably in powder or granule form.

What is claimed is:

1. A mixed powder or mixed granule comprising at least 80% by weight of a mixture of (a) from 5 to 95% by weight of at least one of glutamic acid-N,N-diacetic acid and one or more salts thereof of formula (I)

$$MOOC—(CH_2CH_2—)C(—H)(—COOM)(—N(CH_2COOM)_2) \quad (I)$$

where

M is H, $NH_4$, or alkali metal, (b) from 40 to 95% by weight of at least one polyethylene glycol, and (c) optionally, a polymer selected from the group consisting of a polyvinyl alcohol, a polyvinylpyrrolidone, a polyalkylene glycol other than polyethylene glycol and mixtures thereof, wherein % by weight for (a), (b) and (c) is based on the total weight of (a), (b) and (c) and % by weight for the mixture is based on the total weight of the mixed powder or mixed granule.

2. The mixed powder or mixed granule according to claim 1, wherein component (a) is an alkali metal salt of glutamic acid-diacetic acid.

3. The mixed powder or mixed granule according to claim 1, wherein the polyethylene glycol has a weight-average molecular weight of from 500 to 30000 g/mol.

4. The mixed power or mixed granule according to claim 1, wherein the polyethylene glycol has a weight average molecular weight of from 1,000 to 5,000 g/mol.

5. The mixed powder or mixed granule according to claim 1, further comprising:

a polyethylene glycol having $C_{1-6}$-alkyl end groups.

6. The mixed power or mixed granule according to claim 1, wherein the polyethylene glycol is present in an amount of 40-60% by weight.

7. The mixed power or mixed granule according to claim 1, wherein the polyethylene glycol is present in an amount of 40-50% by weight.

8. The mixed power or mixed granule according to claim 1, wherein M is $NH_4$ in formula (I).

9. The mixed power or mixed granule according to claim 1, wherein M is an alkali metal in formula (I).

10. The mixed power or mixed granule according to claim 1, wherein M is sodium in formula (I) and the composition further comprises as a nonionic surfactant a copolymer containing ethylene oxide and propylene oxide blocks.

11. The mixed powder or mixed granule according to claim 1, further comprising:

a nonionic block copolymer having ethylene oxide and propylene oxide block units.

12. The mixed powder as claimed in claim 1, comprising:

at least one nonionic surfactant (c) selected from the group consisting of alkoxylated primary alcohols, alkoxylated fatty alcohols, alkylglycosides, alkoxylated fatty acid alkyl esters, amine oxides and polyhydroxy fatty acid amides.

13. The mixed powder according to claim 1, further comprising a nonionic surfactant having a melting point of above 20° C.

14. A process for producing the mixed powders or mixed granules according to claim 1, comprising dissolving components (a) and (b) in a solvent and spray-drying the resulting mixture, which may be followed by a granulation step.

15. A process for producing the mixed powders or mixed granules according to claim 1, comprising mixing components (a) and (b) as a powder, heating the mixture and adjusting the powder properties in the subsequent cooling and shaping process.

16. A method comprising:

washing at least one of textiles, tableware and kitchenware with the mixed powder or granule of claim 1.

17. A solid laundry detergent comprising a mixed powder or mixed granule according to claim 1 and, if appropriate, at least one surfactant.

18. A solid dishwasher detergent comprising a mixed powder or mixed granule according to claim 1 and, if appropriate, at least one surfactant.

19. The composition as claimed in claim 17 in powder or granule form.

* * * * *